US010775049B2

(12) United States Patent
Bell

(10) Patent No.: US 10,775,049 B2
(45) Date of Patent: Sep. 15, 2020

(54) COOKING GAS APPLIANCE

(71) Applicant: Furrion Property Holding Limited, Hong Kong (HK)

(72) Inventor: Steven Neill Bell, Hong Kong (HK)

(73) Assignee: Furrion Property Holding Limited, Hong Kong (HK)

( * ) Notice: Subject to any disclaimer, the term of this patent is extended or adjusted under 35 U.S.C. 154(b) by 45 days.

(21) Appl. No.: 15/368,057

(22) Filed: Dec. 2, 2016

(65) Prior Publication Data

US 2018/0156468 A1 Jun. 7, 2018

(51) Int. Cl.
*F24C 15/30* (2006.01)
*F24C 15/20* (2006.01)
*A47B 77/08* (2006.01)

(52) U.S. Cl.
CPC ..... *F24C 15/30* (2013.01); *A47B 77/08* (2013.01); *F24C 15/20* (2013.01)

(58) Field of Classification Search
CPC ..... F24C 15/30; F24C 15/20; A47B 77/08
USPC ..... 126/211
See application file for complete search history.

(56) References Cited

U.S. PATENT DOCUMENTS 3,142,295 A * 7/1964 Blee ..... A47B 77/08 126/37 R
3,257,543 A * 6/1966 Regan ..... F24C 15/104 126/214 A
3,270,183 A * 8/1966 Jordan ..... F24C 14/02 219/398
4,133,336 A 1/1979 Smith
4,924,763 A * 5/1990 Bingham ..... A21B 1/26 126/21 A
5,535,742 A * 7/1996 Neff ..... F24C 15/36 126/211
5,911,748 A 6/1999 Boxum
5,931,151 A 8/1999 Van Dore et al.
6,339,212 B1 * 1/2002 Campbell ..... F24C 7/082 219/452.11
8,333,183 B2 * 12/2012 Nam ..... F24C 15/006 126/273 R
9,447,978 B2 9/2016 Ruperee
2003/0024525 A1 * 2/2003 Jennings ..... F23D 14/045 126/39 R
2012/0266858 A1 * 10/2012 Avila ..... F24C 15/086 126/273 R
2013/0327315 A1 * 12/2013 Sosso ..... F24C 15/20 126/39 E

OTHER PUBLICATIONS

Whirlpool, "Installation Instructions", 1994. (Year: 1994).*

(Continued)

*Primary Examiner* — Grant Moubry
*Assistant Examiner* — Rabeeul I Zuberi
(74) *Attorney, Agent, or Firm* — Faegre Drinker Biddle Reath LLP

(57) ABSTRACT

A cooking apparatus includes a housing having a first cutout and a second cutout, an oven, a cook top and a vent assembly. The oven is positioned within the first cutout. The cooktop is positioned within the second cutout and the vent assembly is coupled to the oven.

16 Claims, 8 Drawing Sheets

(56) References Cited

OTHER PUBLICATIONS

Atwood. "Introducing Stove Wrap: Range & Cooktop Stove Liner Displays." Atwood Product Brochure. Accessed online: http://www.askforatwood.com/images/stovewrapbrochure.pdf, Jan. 22, 2015 (earliest date document is known to have existed on Atwood's website), 1 page.
Atwood. "Atwood Helium Refrigerators." Atwood Product Brochure. Accessed online: https://www.americanrvcompany.com/assets/images/Atwood/HeliumRefer.pdf, Feb. 6, 2012 (earliest date document is known to have existed on Atwood's website), 12 pages.
Atwood. "LP Gas Range & Slide-In Cooktops." Product Instructions, Literature No. MPD 51381, Effective Jan. 16, 2008, 8 pages.
Atwood. "LP Gas Range & Slide-In Cooktops." Product Instructions, Literature No. MPD 52229, Effective Jan. 12, 2012, 16 pages.
Atwood. "RV Refrigerator LP-Gas & Electric HE-0601, HE-0801." Product Instructions, Literature No. MPD 4003333, Effective Jan. 15, 2011, 10 pages.
Atwood. "RV Refrigerator LP-Gas & Electric HE-0601, HE-0801." Product Instructions, Literature No. MPD 4003333, Effective Sep. 26, 2013, 10 pages.
Dyers. "Dometic: Ice Maker Heater Tape Installation Instructions." Product Instructions, Revision Form No. 3108435.037, Jun. 2004, 6 pages.
Girard Products, LLC. "Owner's Manual—Model: GSWH-1M. Demand Tankless Water Heater LP Gas Power Blower Induced Draft Gas Modulation Control." Product Instructions, Feb. 8, 2012, 40 pages.
Girard Products, LLC. "Owners Manual—Model: GSWH-2." Product Instructions, Aug. 2015, 48 pages.

* cited by examiner

COOKING GAS APPLIANCE

FIELD OF THE DISCLOSURE

The present disclosure relates to a cooking assembly. More particularly the present disclosure relates to a built-in oven and cooktop cooking assembly for recreational vehicle applications.

BACKGROUND OF THE DISCLOSURE

The recreational vehicle (RV) market has been growing in recent years. Increasingly, consumers want to retain the conveniences and luxuries of home while away from home. In particular, consumers are demanding more luxuries and aesthetic appeal in the kitchen.

Cooking appliances such as ovens and cooktops for use in the recreational vehicle industry are subject to numerous regulations. Such regulations impact design specifications of ovens such as but not limited to the location of air inlet ports and air outlet ports. For example, Article 1.21.3 of the American National Standard For Recreational Vehicle Cooking Gas Appliances states: "Vent openings and flue deflectors shall not be located on a front vertical surface below the 36 in (914 mm) level." Additionally, these regulations also can constrain the size of such appliances. Therefore, maximizing the size of the cooking appliances while maintaining compliance with the regulations in the recreation vehicle industry is a constant goal of manufacturers.

SUMMARY

The present disclosure provides a cooking assembly with slide in components. The cooking assembly provides a cabinet with cutouts configured to receive various components of the cooking assembly.

According to an embodiment of the present disclosure, a cooking assembly is provided. The cooking assembly includes: a housing having: a front surface, a top surface, a bottom surface, a back surface, a first side surface, and a second side surface connected together to define a space; a first cutout formed in the front surface of the housing, the first cutout defined by a first side edge, a second side edge that is parallel the first side edge, a first top edge that is perpendicular to the first side edge and the second side edge, and a first bottom edge that is parallel to the first top edge and perpendicular to the first side edge and the second side edge; a second cutout sized formed in the top surface of the housing, the second cutout defined by a third side edge, a fourth side edge that is parallel to the third side edge, a second front edge that is perpendicular to the third side edge and the fourth side edge, and a second back edge that is perpendicular to the third side edge and the fourth side edge; an oven having a pivotal door on a front surface and a back panel parallel to and opposite the front panel and an oven enclosure, the oven at least partially positioned within the first cutout such that the first side edge, the second side edge, the first top edge and the first bottom edge are adjacent to the front surface of the oven; a cooktop at least partially positioned within the second cutout and coupled to the oven, the cooktop spaced apart from the front surface of the housing and the back surface of the housing; and a vent assembly coupled to the oven and forming a fluid flow path vertically out of the oven enclosure, the vent assembly adjacent to the back surface of the housing.

According to another embodiment of the present disclosure, a method of assembling a cooking assembly is provided. The method of assembly includes: inserting an oven into a first cutout formed in the front panel of a housing, the oven having a front panel, a top panel, a bottom panel, a back panel, a first side panel, and a second side panel to define an oven enclosure, the oven enclosure in fluid communication with ambient air outside the oven, and the housing having a front surface, a top surface, a bottom surface, a back surface, a first side surface, and a second side surface; inserting a vent into a second cutout formed in the top surface of the housing such that the vent is in fluid communication with the oven enclosure; coupling the vent along a top panel at an air outlet of the oven adjacent to the back panel of the oven; inserting a cooktop into the second cutout formed in the top surface of the housing such that the cooktop is spaced apart from the front surface and the back surface of the housing.

BRIEF DESCRIPTION OF THE DRAWINGS

The above-mentioned and other features and advantages of this disclosure, and the manner of attaining them, will become more apparent and will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION

Figure 1:
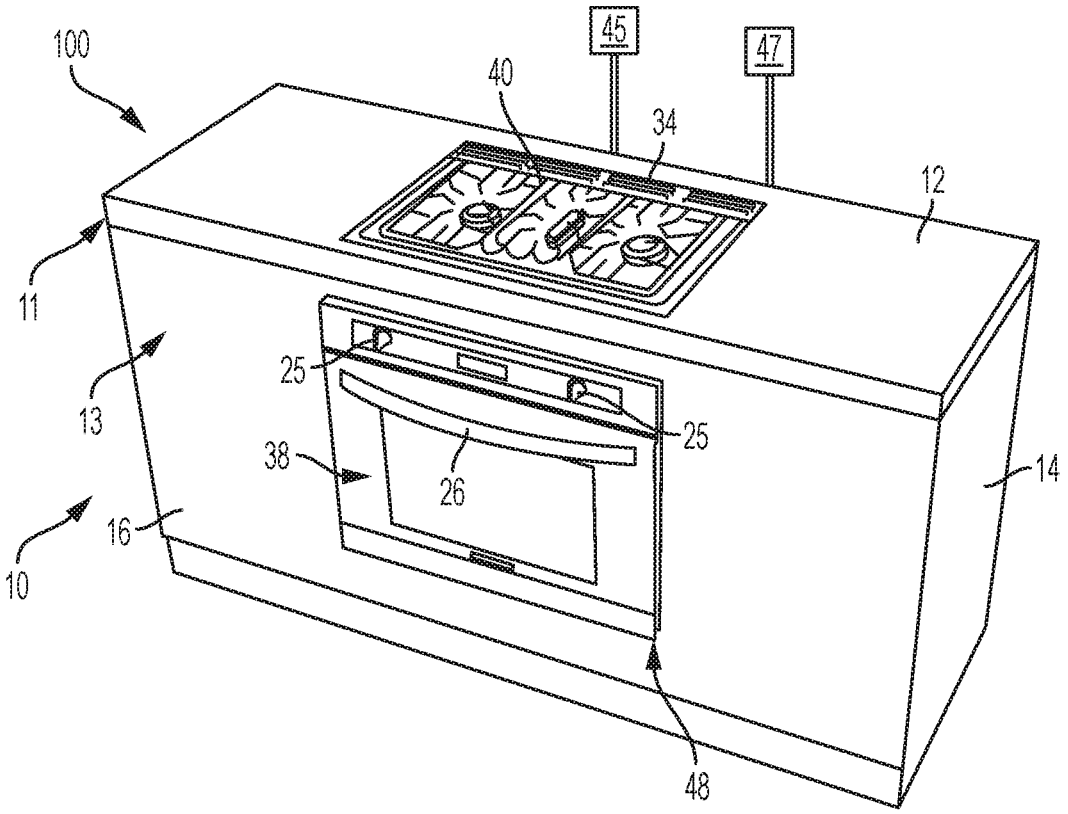
FIG. 1 is a perspective view of an assembled cooking assembly.

For the purposes of promoting an understanding of the principles of the invention, reference will now be made to the embodiments illustrated in the drawings, which are described below. The embodiments disclosed below are not intended to be exhaustive or limit the invention to the precise form disclosed in the following detailed description. Rather, the embodiments are chosen and described so that others skilled in the art may utilize their teachings. It will be understood that no limitation of the scope of the invention is thereby intended. The invention includes any alterations and further modifications in the illustrative devices and described methods and further applications of the principles of the invention which would normally occur to one skilled in the art to which the invention relates.

Referring first to FIG. 1, a cooking assembly 100 is shown. Cooking assembly 100 may be used in recreational vehicles including but not limited to camper vans, caravans, motorhomes, towable trailers, travel trailers, fifth wheel trailers, toy haulers, popup trailers, slide-in campers, truck campers, tear drop trailers, and popup campers. Cooking assembly 100 includes: a housing 10, an oven 22, a vent assembly 30, and a cooktop 40 that is removable with respect to housing 10 as discussed further below. In a fully assembled configuration, oven 22 is positioned at least partially within housing 10 with oven 22 extending from the front surface 16 of the housing. Cooktop 40 is positioned at least partially within housing 10 with cooktop 40 extending from the top surface 12 of housing 10. Vent assembly 30 is positioned at the back of the cooking assembly 100 and at least partially within housing 10. Housing 10, oven 22, vent assembly 30, and cooktop 40 can be coupled or connected to one another to form cooking assembly 100.

Housing 10 includes a front surface 16, a back surface 17, a top surface 12, a bottom surface 19, and first and second side surfaces 14*a* and 14*b* (referred to collectively as side surfaces 14) to define an area within which oven 22, vent assembly 30, and cooktop 40 are installed as discussed further below. In some embodiments, housing 10 may include shelves and drawers for storage of, for example, kitchen equipment and tools and foodstuff. In some embodiments, housing 10 includes a countertop 11 and a cabinet 13 with heights 57 and 59 respectively. In some embodiments, countertop 11 and cabinet 13 are coupled to each other. For example, countertop 11 may rest flush or substantially flush on the top surface of the cabinet 13 and may join cabinet 13 at a butt joint. Countertop 11 can include a recess in which the top surface of the cabinet 13 fits such that at least a portion of the countertop 11 overhangs the cabinet 13. In some embodiments, counter top 11 and cabinet 13 are integrally formed with one another. Suitable materials for the countertop 11 include stone, such as quartz, granite, soapstone, limestone and marble, laminate, glass, wood, stainless steel, concrete, tile, and solid-surfacing materials containing for example acrylic, polyester or a combination of acrylic and polyester. Suitable materials for cabinet 13 include wood, laminate and thermofoil With Reference to FIG. 2, housing 10 includes a first cutout 18 in the front surface 16 and a second cutout 20 in the top surface 12. First cutout 18 is configured to receive oven 22 as described further below and is formed in the front surface 16 of housing 10 extending towards back surface 17. First cutout 18 is defined by first and second side edges 18*a*, 18*b*, a top edge 18*c*, and a bottom edge 18*d*. In some embodiments, first and second side edges 18*a* and 18*b* are parallel or substantially parallel to one another and top edge 18*c* and bottom edge are parallel or substantially parallel to one another. Further, first and second side edges 18*a* and 18*b* can be perpendicular or substantially perpendicular to top edge 18*c* and bottom edge 18*d*.

In some embodiments, first cutout 18 has a height 64 and width 52 suitable for receiving the oven 22. For example, in some embodiments, first cutout 18 has a height 64 which may be as little as 19 inches, 19.5 inches, 20 inches, as great as 21 inches, 21.5 inches, 22 inches, or within any range defined between any two of the foregoing values. In some embodiments, height 64 is about 20.3 inches. In some embodiments, first cutout 18 has a width 52 which may be as little as 22 inches, 22.5 inches, 23 inches, as great as 24 inches, 24.5 inches, 25 inches, or within any range defined between any two of the foregoing values. In some embodiments, width 52 is about 23.5 inches.

Figure 2:
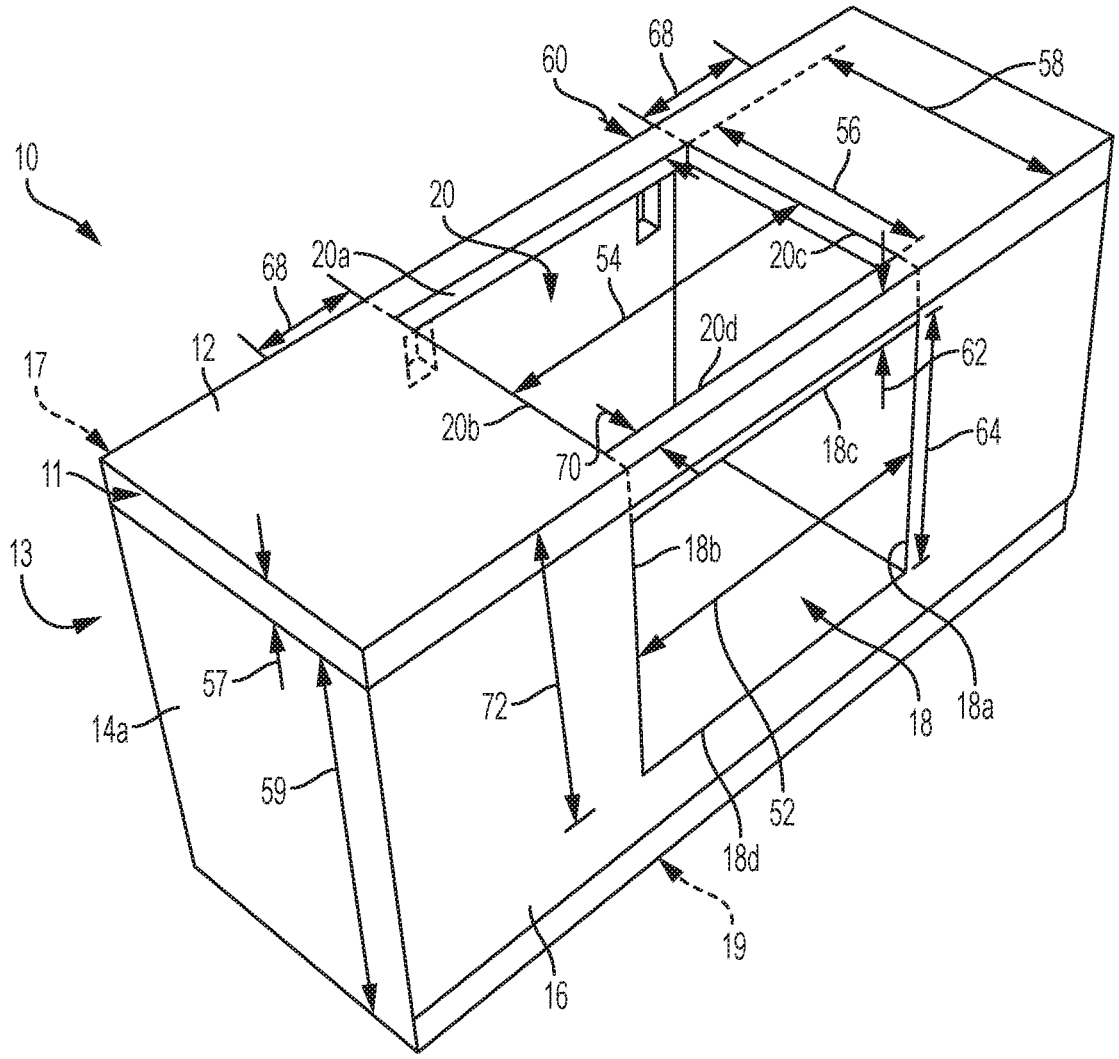
FIG. 2 is a perspective view of a housing for the cooking assembly of FIG. 1.

As shown in FIG. 2, first cutout 18 spans a portion of front surface 16 and is spaced from top surface 12, bottom surface 19, back surface 17, and side surfaces 14. Top edge 18*c* of first cutout 18 is spaced from top surface 12 by a distance 62. Suitable distances 62 include values that may be as little as 1 inch, 2 inches, 4 inches, as great as 6 inches, 7 inches, 8 inches, or within any range defined between any two of the foregoing values. In an exemplary embodiment, distance 62 is 4 inches. Side surfaces 18*b*, 18*c* of cutout 18 are also spaced from side surfaces 14 by distances 68*a* and 68*b*, respectively, as measured on both edges of cutout 18 as shown in FIG. 2. Distances 68 vary depending on the configuration of cabinet 13 and countertop 11 of housing 10 within the context of a kitchen area. Distances 68 may be as little as 2 inches, 3 inches, 4 inches, as great as 6 inches, 7 inches, 8 inches, or within any range defined between any two of the foregoing values. In one embodiment, distances 68 may have the same value of at least 2 inches. In other embodiments, distances 68*a* and 68*b* may be different.

Second cutout 20 is configured to receive cooktop 40 and vent assembly 30 as described further below and is formed in the top surface 12 of housing 10 extending towards bottom surface 19. Second cutout 20 is defined by first and second side edges 20*b*, 20*c*, front edge 20*d*, and back edge 20*a*. First and second edges 20*b* and 20*c* may be parallel or substantially parallel and front edge 20*d* and back edge 20*a* may be parallel or substantially parallel. Further, first and second edges 20*b* and 20*c* may be perpendicular or substantially perpendicular to front edge 20*d* and back edge 20*a*.

Second cutout 20 has a height 72 which may be as little as 23 inches, 23.5 inches, 24 inches, as great as 25 inches, 25.5 inches, 26 inches, or within any range defined between any two of the foregoing values. As shown in FIG. 2, height 72 of second cutout 20 intersects a portion of the interior defined by first cutout 18. As such, in an exemplary embodiment, height 72 of second cutout 20 may be the sum of height 64 and distance 62. Second cutout 20 has a width 54 defined between first edge 20*b* and second edge 20*c*. In some embodiments, width 54 may be as little as 22 inches, 22.5 inches, 23 inches, as great as 24 inches, 24.5 inches, 25 inches, or within any range defined between any two of the foregoing values. Cutout 20 spans a distance 56 along top surface 12 defined between front edge 20*d* and back edge 20*a*. In some embodiments, distance 56 may be as little as 15 inches, 15.5 inches, 16 inches, as great as 17 inches, 17.5 inches, 18 inches, or within any range defined between any two of the foregoing values. For example, width 54 may be 23.5 inches. In some embodiments, first cutout 18 and second cutout 20 have equal or substantially equal widths, i.e. width 54 and width 52 are equal or substantially equal to one another. In some embodiments, first edge 20*b* of second cutout 20 may be aligned or substantially aligned with second edge 18*b* of the first cutout 18. Similarly, second edge 20*c* of second cutout 20 may be aligned or substantially aligned with first edge 18*a* of the first cutout 18. In some embodiments, distance 56 is 16.75 inches.

Second cutout 20 spans a portion of top surface 12 and is spaced from back surface 17, front surface 16, bottom surface 19, and side surfaces 14. First edge 20*d* of second cutout 20 is spaced from front surface 16 by a distance 70 that may be as little as 1 inch, 1.25 inches, 1.5 inches, as great as 1.75 inches, 1.85 inches, 2 inches, or within any range defined between any two of the foregoing values. In some embodiments, distance 70 is 1.625 inches. Side edges of 20*b*, 20*c* of cutout 20 are also spaced from side surfaces 14 by distances 68*a* and 68*b* as measured from edges 20*b*, 20*c* as shown in FIG. 2. Distances 68*a* and 68*b* may be as little as 2 inches, 3 inches, 4 inches, as great as 6 inches, 7 inches, 8 inches, or within any range defined between any two of the foregoing values. In some embodiments, distances 68*a* and 68*b* may be equal and may be, for example, at least 2 inches. However, it is contemplated that, in alternate embodiments, distances 68*a* and 68*b* be different from one another. Finally, back edge 20*a* of second cutout 20 is spaced from back surface 17 by a distance 60 that may be as little as 2 inches, 3 inches, 4 inches, as great as 6 inches, 7 inches, 8 inches, or within any range defined between any two of the foregoing values. In an exemplary embodiment, distance 60 is at least 2 inches.

Housing 10 with first cutout 18 and second cutout 20 defines a space having a depth 58 for accommodating oven 22 and cooktop 40. Depth 58 may be as little as 17 inches, 17.5 inches, 18 inches, as great as 19 inches, 19.5 inches, 20 inches, or within any range defined between any two of the foregoing values. In some embodiments, depth 58 is about 18.4 inches. Back edge 20*a* is spaced apart from back surface 17 by a distance 60. In some embodiments, distance 60 may be as little as 2 inches, 3 inches, 4 inches, as great as 6 inches, 7 inches, 8 inches, or within any range defined between any two of the foregoing values. In some embodiments, distance 60 is at least 2 inches.

Figure 3:
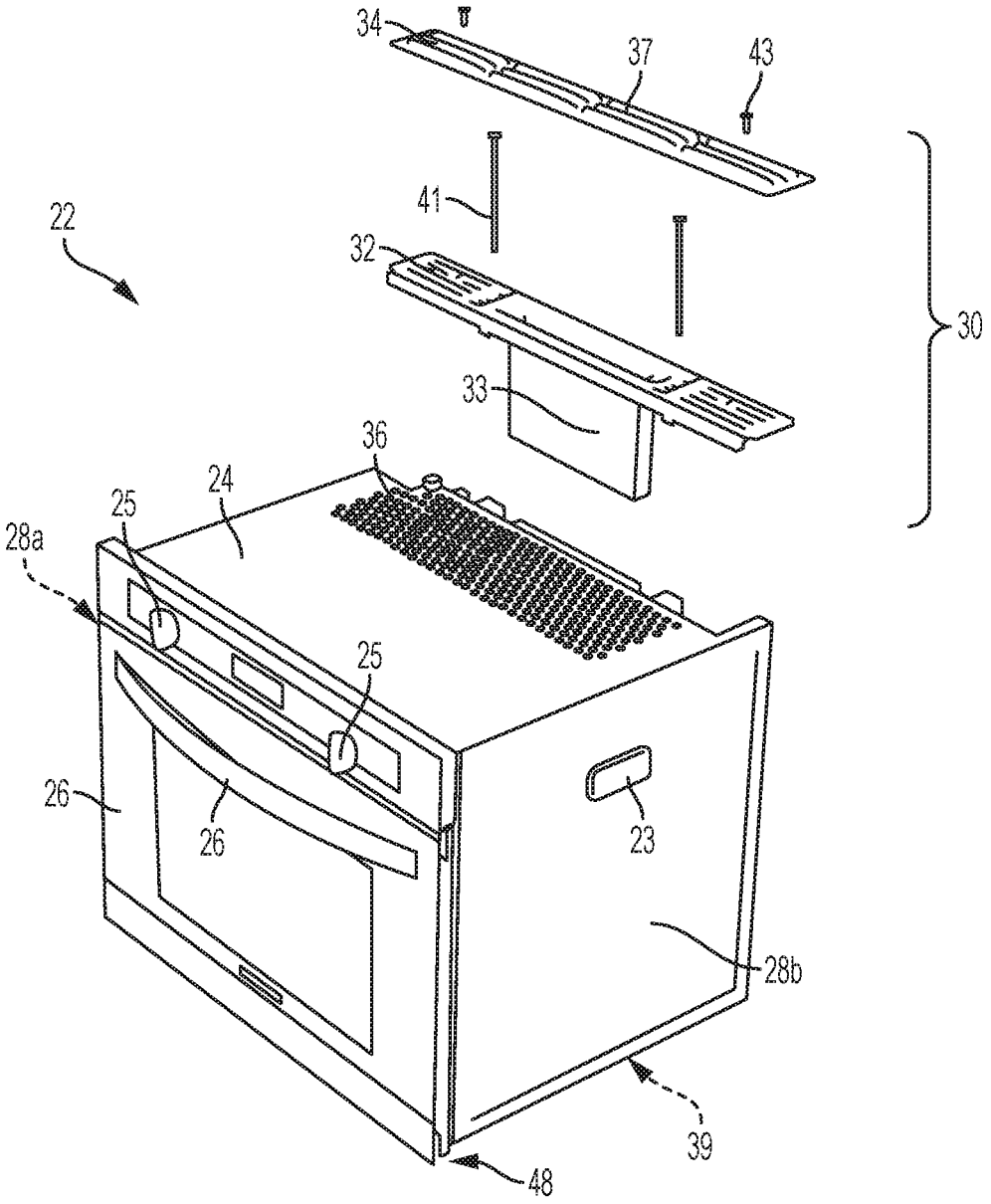
FIG. 3 is an exploded perspective view of a vent assembly of the cooking assembly of FIG. 1.
Figure 8:
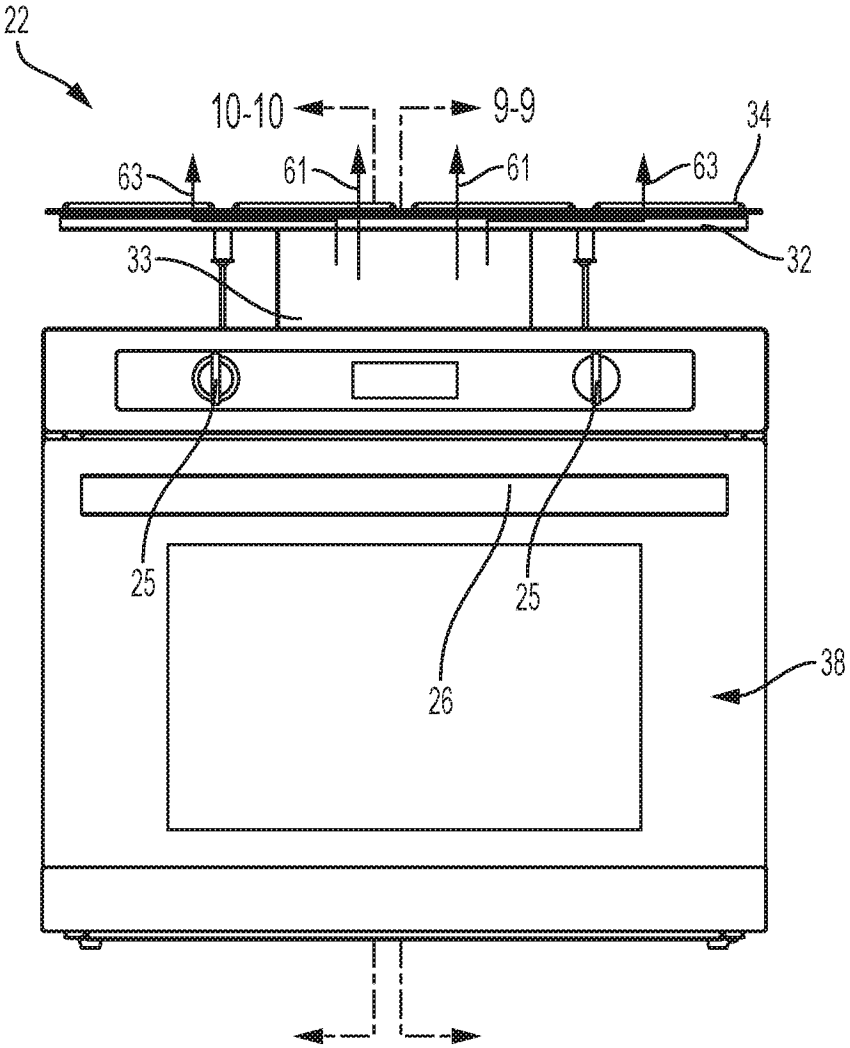
FIG. 8 is a front view of the cooktop of FIG. 3.

As mentioned earlier, first cutout 18 is sized and shaped to receive oven 22 as shown in FIG. 1. Referring now to FIGS. 1, 3 and 8, oven 22 includes a front panel 38, a top panel 24, back panel 46, bottom panel 39, and first and second side panels 28*a* and 28*b* (referred to collectively as side panels 28) to define oven enclosure 50. As shown, front panel 38 includes an oven door 26 pivotably connected to oven 22. Opening oven door 26 allows a user to access oven enclosure 50. Side panels 28 include indentations 23 that are configured to allow a user fit their hand within indentations 23 for the purposes of lifting and/or moving oven 22. For example, indentations 23 may have a suitable size and shape for a human hand. An air inlet 48 may be formed along the bottom surface of the oven 22 and may be defined between the front panel 38 and the bottom panel 39. In use, oven enclosure 50 is in fluid communication with air inlet 48.

Figure 9:
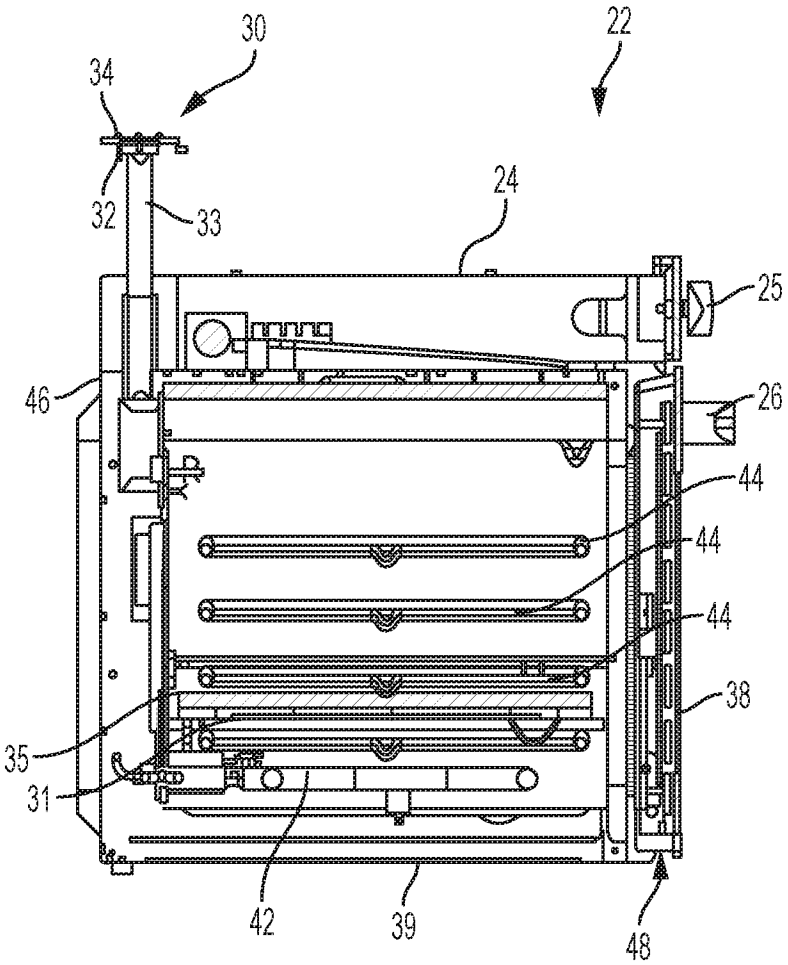
FIG. 9 is a cross-sectional view of the oven of FIG. 8 taken along line 9-9.

FIG. 9 is a cross-sectional view of oven 22 taken along line 9-9 in FIG. 8. As shown in FIG. 9, burner 42, plates 31 and 35, and shelves 44 are positioned within oven enclosure 50. In some embodiments, plates 31 and 35 are metal plates. Burner 42 is positioned below shelves 44 within oven enclosure 50. During use, burner 42 heats air within oven enclosure 50. To provide heat, burner 42 is connected to an energy source 45, such as propane or natural gas, by a conduit or pipe. In some embodiments, burner 42 can be connected to dials 25 on front panel 38. For example, dials 25 may be used to control the amount of heat applied (i.e., the temperature within oven 22).

Plates 31 and 35 are coupled to one another and positioned between shelves 44 and burner 42. Plate 31 is positioned closer to burner 42 than plate 35 and may include a plurality of apertures (not shown) to permit air to flow through plate 31. Plate 35 is removable and is positioned above plate 31 and may may block air flow through the center portion of the oven, directing air flow towards the walls of oven enclosure 50 and towards air outlet 49. In some embodiments, plate 35 may be removed from oven enclosure 50 such that heated air only moves through the apertures of plate 31 as the air ascends within oven enclosure 50.

Figure 10:
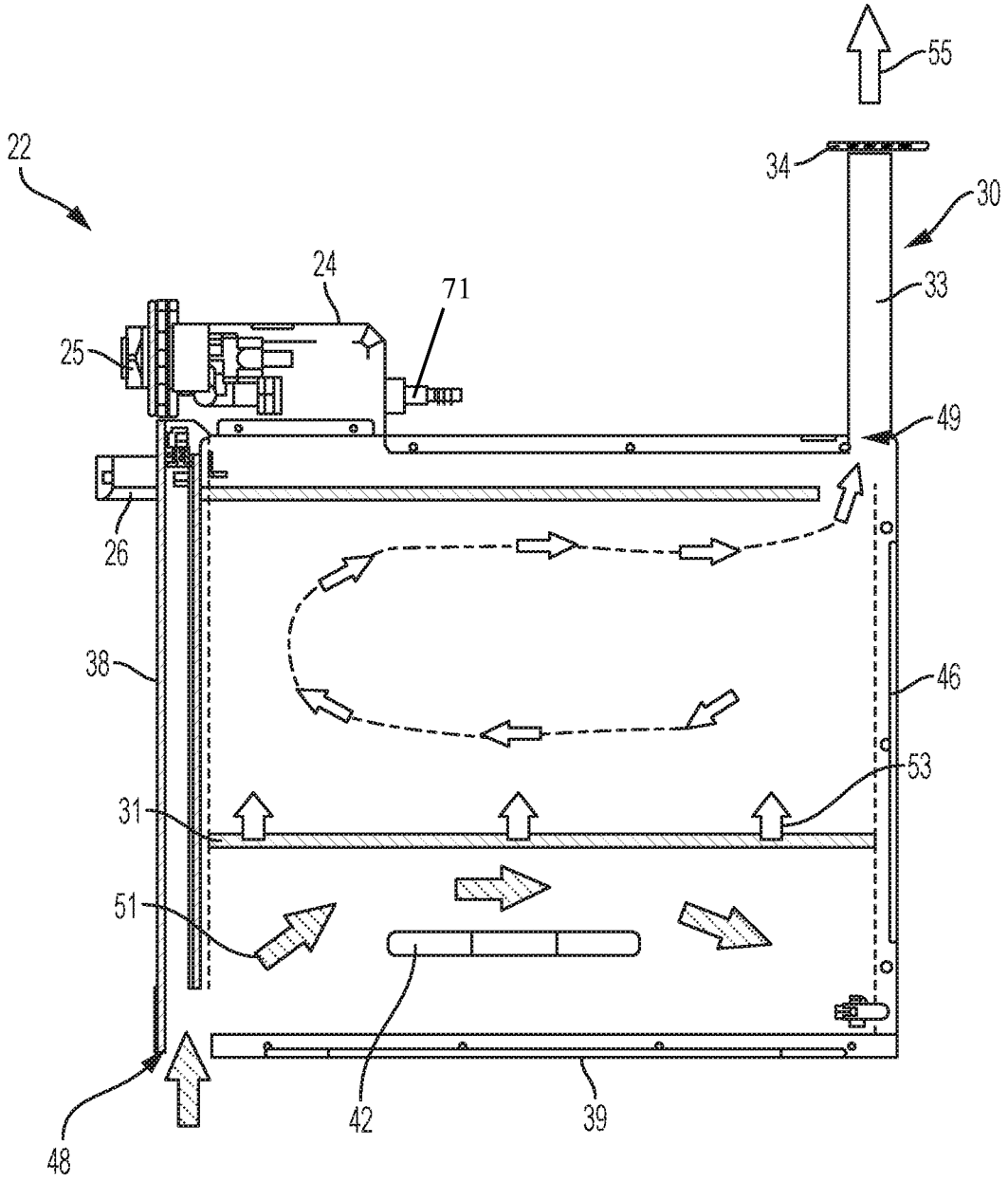
FIG. 10 is a cross-sectional view of the oven of FIG. 8 taken along line 10-10.

FIG. 10 is a cross-sectional diagram of the oven 22 taken along line 10-10 of FIG. 8 and illustrates the flow of air within oven enclosure 50. As shown, air enters oven 22 through the air inlet 48 in the direction of arrow 51. As air absorbs heat generated by burner 42, the heated air begins to rise and moves in the direction of arrow 53 through the holes of metal plate 31 due to natural convection. As the air continues to rise along arrow 53, a portion of the heat is transferred to shelves 44 and the content that may be resting on shelves 44 (e.g., food items). The heated air then exits the oven 22 through air outlet 49 and vent assembly 30 in the direction of arrow 55.

As shown in at least FIG. 3, top panel 24 of oven 22 includes a plurality of apertures 36 that are positioned along the surface of top panel 24. Apertures 36 are positioned above electronic components within oven 22 and serve to dissipate heat generated from the electronic components. As mentioned earlier, top panel 24 also includes air outlet 49

As also shown in FIG. 3, vent assembly 30 includes a vent 32 and a vent cover 34. Vent 32 provides an extension of air outlet 49 (FIG. 10) by a conduit 33, which couples vent 32 to oven 22 at air outlet 49. Conduit 33 is in fluid communication with oven enclosure 50 and provides a pathway for air to flow upward from oven enclosure 50 through vent assembly 30. As such, air exiting oven enclosure 50 will move through air outlet 49 and conduit 33 toward vent cover 34 to exit oven 22.

Vent cover 34 is coupled to vent 21 along the top surface of vent 32 and includes apertures 37. Vent cover 34 serves to distribute exiting air from oven 22. When heated air moves through conduit 33 of vent 32, vent cover 34 allows some of the heated air to continue moving vertically along arrow 61 through vent cover 34 without significantly changing its flow path. However, a portion of the heated air is unable to flow along this path due to the small size of apertures 37 along this flow path. As such, vent cover 34 funnels the remaining heated air outwards towards the edges of vent 32 and vent cover 34 such that the heated air can exit oven 22 through the apertures 37 provided on this part of vent cover 34 as indicated by arrow 63.

Vent cover 34 also prevents external debris from entering oven 22 due to the relatively small size of apertures 37. In an alternate embodiment, vent assembly 30 is made of a single piece where vent 32 and vent cover 34 are integrally formed.

Cooking assembly 100 includes a cooktop 40. When cooking assembly 100 is assembled, cooktop 40 is inserted into second cutout 20 (FIG. 7), is coupled to oven 22 along top panel 24, and is spaced apart from back surface of housing 10. Furthermore, when coupling cooktop 40 onto oven 22 along top panel 24, connector 67 on cooktop 40 couples to front panel 38 (e.g., connector 67 of cooktop 40 couples to connector 71 (FIG. 10) protruding from front panel 38) such that dials 25 on the front panel 38 can control the settings of cook top 40 (e.g., flowrate of gas to control the flame height). Cooktop 40 spans the exposed area of top panel 24 within second cutout 20 such that no gap exists between top surface 12 of housing 10 and cooktop 40. In some embodiments, the upper surface of cooktop 40 is substantially flush with top surface 12.

Figure 4:
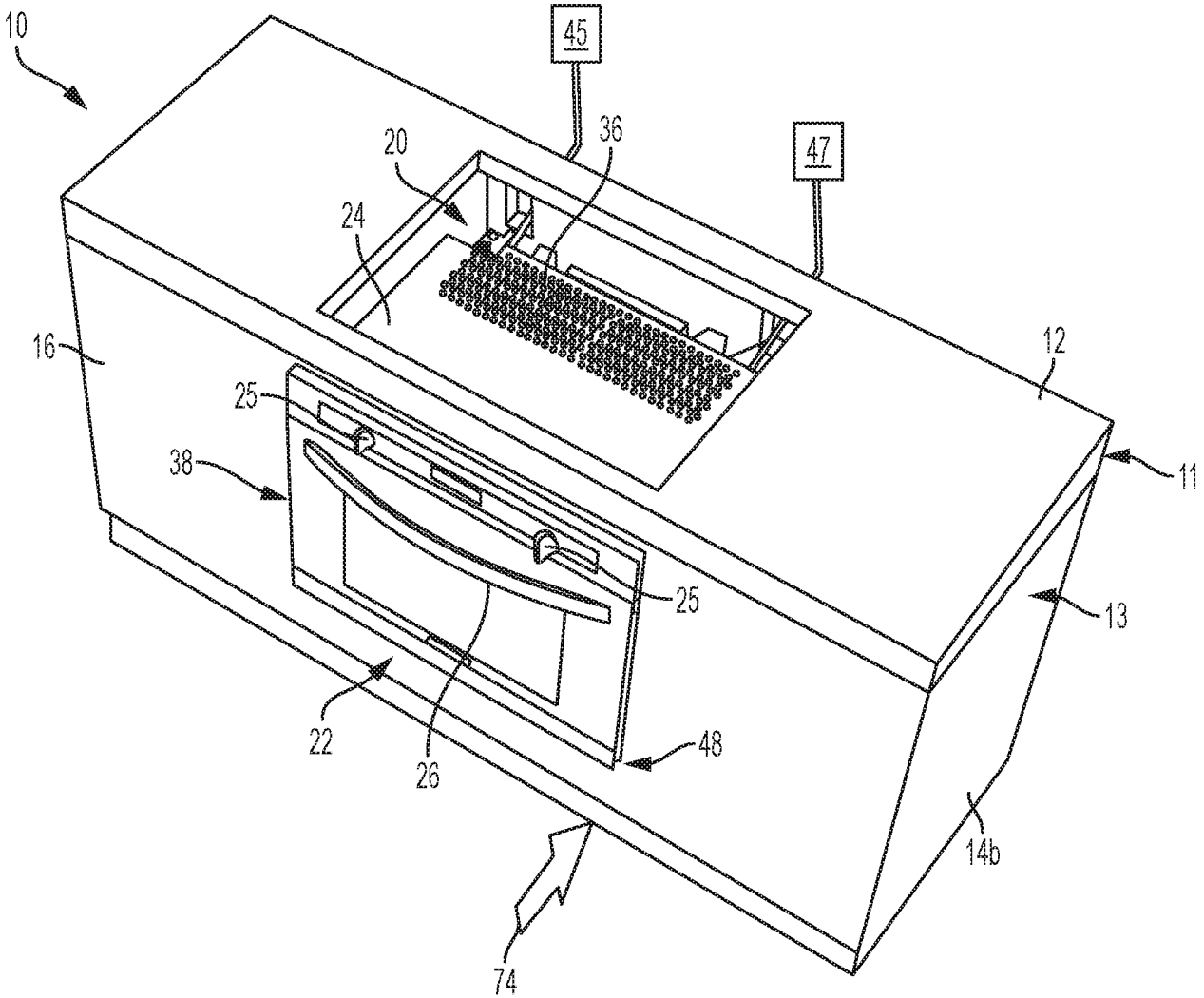
FIGS. 4-7 are perspective views illustrating the assembly of a cooking assembly.

FIGS. 4-7 illustrate a method of assembling cooking assembly 100. First, housing 10 is cut to form a first cutout 18 in front surface 16 and a second cutout 20 is formed in top surface 12. As illustrated in FIG. 4, oven 22 is inserted into first cutout 18 of housing 10 in the direction of arrow 74 until front panel 38 and oven door 26 protrudes from front surface 16. Oven 22 can be coupled to housing 10. In some embodiments, oven 22 is coupled to housing 10 by a plurality of screws. However, it is contemplated that, in alternate embodiments, alternate fastening means may be used such as fasteners or couplers. After oven 22 is inserted into first cutout 18, oven 22 is connected to an energy source 45 and a power source 47 by a conduit such as a pipe or cord. In some embodiments, the power source is a 12V power source. Power source 47 provides electricity to cooking assembly 100 such that oven 22 and cooktop 40 perform a function when a user actuates one of dials 25. Energy source 45 provides an energy source, such as natural gas or propane, to cooktop 40 and oven 22 such that cooktop 40 and oven 22 provide heat for example to cook or bake foodstuff.

Figure 5:
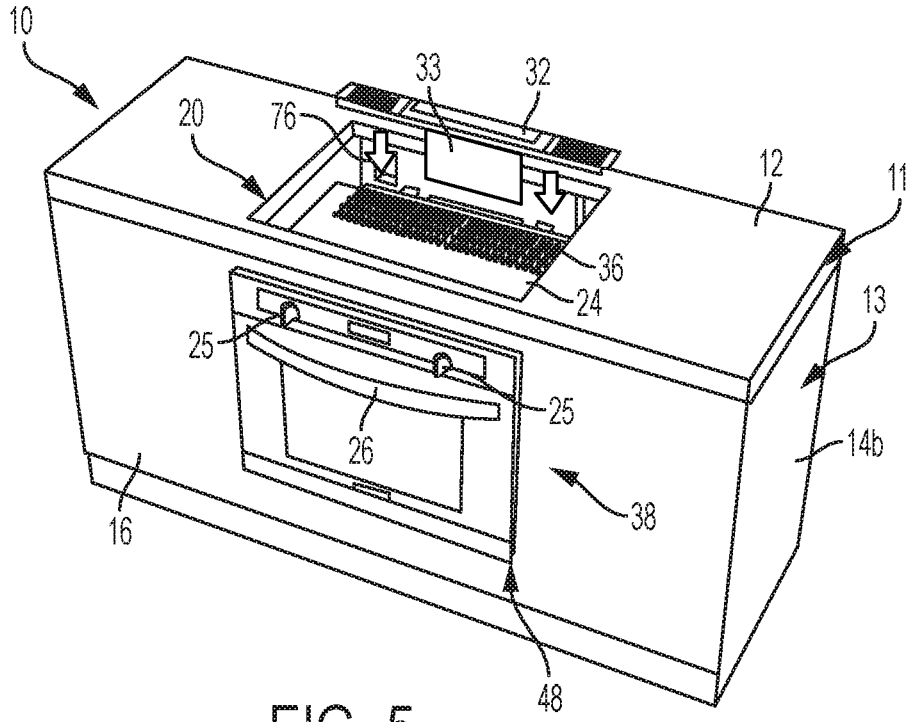
Figure 6:
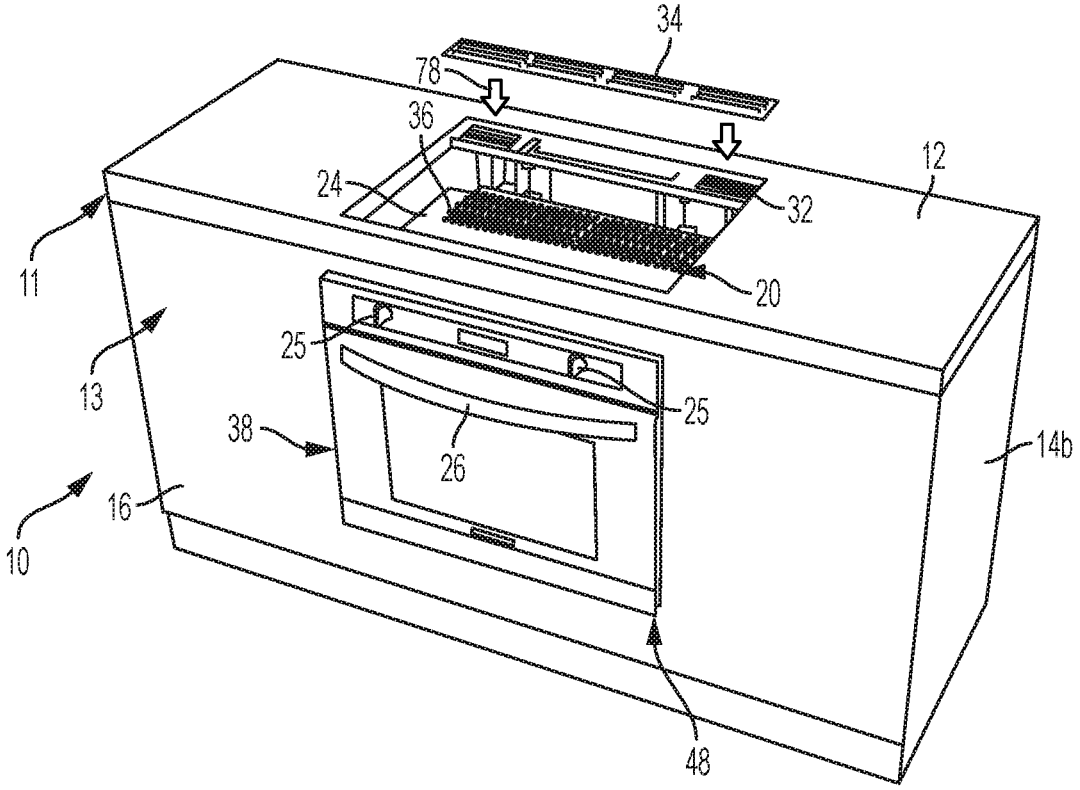

After oven 22 is inserted into first cutout 18 and connected to the energy source 45 and power source 47, vent 32 of vent assembly 30 is inserted into second cutout 20 in the direction of arrow 76 such that vent 32 is coupled to oven 22 as shown in FIG. 5. Conduit 33 connects to oven 22 to form a fluid path for the air from the interior of the oven 22 through the vent 32. In one embodiment, vent 32 is coupled to oven 22 at air outlet 49 by a pair of screws 41. However, it is contemplated that, in alternate embodiments, alternate fastening means may be used such as fasteners, couplers, etc.

After inserting vent 32, vent cover 34 is coupled to vent 32 as shown by arrow 78 in FIG. 5. In some embodiments, vent cover 34 is coupled to vent 32 by a pair of screws 43. However, it is contemplated that, in alternate embodiments, alternate fastening means may be used such as fasteners, couplers, etc.

Figure 7:
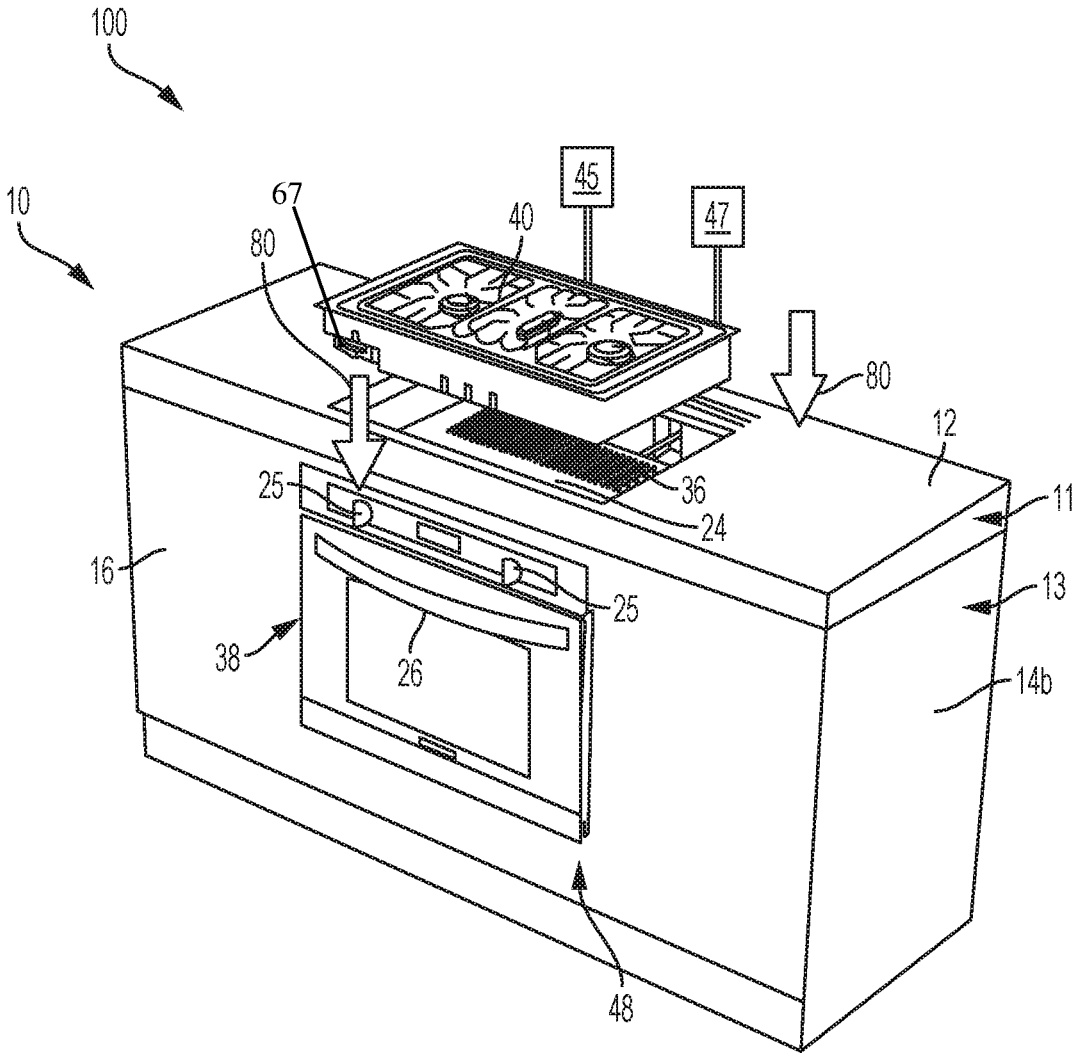

After mounting vent cover 34 onto vent 32, cooktop 40 is connected to the energy source 45 as shown in FIG. 7. In one embodiment, cooktop 40 is also connected to a power source 47. In a further alternate embodiment, the power source is a 1.5V power source. Cooktop 40 is then inserted into second cutout 20 and coupled to the top panel 24 of oven 22 in the direction of arrow 80. In one embodiment, cooktop 40 is coupled to oven 22 by a plurality of screws. However, it is contemplated that, in alternate embodiments, alternate fastening means may be used such as fasteners or couplers. In some embodiments, cooktop 40 has the same or substantially the same width as oven 22. When installed, cooktop 40 is spaced apart from front surface 16, back surface 17, and side surfaces 14.

In the fully assembled configuration, oven 22 fits within first cutout 18 of housing 10, and the front panel 38 is substantially flush with front surface 16. Alternatively, the front panel 38 may protrude from the front surface 16. In some embodiments, the housing 10 may be positioned on a substrate, such as a floor, such that bottom surface 19 of housing 10 is on the substrate. When installed, housing 10 surrounds the front panel 38 of oven 22. For example, housing 10 is positioned below oven 22 between the floor and the oven 22 and above oven 22. Because oven 22 is positioned within first cutout 18, which does not extend to the floor, the front surface 16 of housing 10 maintains a flowing appearance below the oven 22. Additionally, because first cutout 18 does not extend to top surface 12, the front surface 16 of housing 10 maintains a flowing appearance above the oven. In contrast, typical slide-in oven models require a break or cutout to be formed in the kitchen cabinet from the top surface of the cabinet to the floor to enable the oven to be fit into a defined space extending the height of the cabinets. This design creates breaks in the cabinets and has less visual appeal.

Similarly, cooktop 40 may fit within second cutout 20 of housing 10 such that cooktop 40 is substantially flush with the top surface 12 of housing 10. Alternatively, cooktop 40 may protrude from the top surface 12 of housing 10. When cooktop 40 is installed, housing 10 surrounds the cooktop 40 on four sides. Because cooktop 40 does not extend fully from the front surface 16 to the back surface 17 (i.e., cooktop 40 does not adjoin or intersect front surface 16 or back surface 17), top surface 12 has a flowing appearance. In contrast, the top surface 12 would have a less flowing appearance if the cooktop 40 extended to front surface 16 at least because top surface 12 having distance 70 would be eliminated.

Moreover, in some embodiments when vent assembly 30 is coupled to oven 22 within housing 10, vent cover 34 is substantially flush with the top surface 12 of housing 10. In other words, the top surface of the vent cover 34 is in the same horizontal plane as top surface 12 of cooktop 40. Alternatively, vent cover 34 may protrude from the top surface 12 of housing 10. When vent cover 34 is installed, housing 10 surrounds vent cover 34 on four sides. Because vent cover 34 is positioned within second cutout 20 and does not extend fully from back surface 17 to front surface 16 (i.e., vent cover 34 does not adjoin or intersect back surface 17 of front surface 16), top surface 12 has a flowing appearance.

Having a two-part cooking assembly 100 comprised of a separate oven 22 and cooktop 40 provides for easier installation as each component is inserted and connected to their respective power and gas sources as appropriate. It also provides for easy removal of components of cooking assembly 100 such as cooktop 40. For example, for the removal of cooktop 40, a user would need to decouple cooktop 40 from oven 22, disconnect cooktop 40 from power source 47 and energy source 45, and pull cooktop 40 out of second cutout 20 for proper removal. Additionally, the two-part assembly provides flexibility to the consumer as a consumer has the choice of selecting from different types of ovens 22 and different types of cooktops 40 for cooking assembly 100 and is only constrained by the spatial limitations of first cutout 18 and second cutout 20 in housing 10. Furthermore, in recreational vehicles, there are regulations regarding the location of vent openings based on the size of the ovens. Because cooktop 40 and oven 22 are separated, oven 22 can be of a greater size since the size of cooktop 40 is not considered when complying with recreational vehicle regulations.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A cooking apparatus comprising:

a housing having:

a front surface, a top surface, a bottom surface, a back surface, a first side surface, and a second side surface connected together to define a space;

a first cutout formed in the front surface of the housing, the first cutout defined by a first side edge, a second side edge that is parallel the first side edge, a first top edge that is perpendicular to the first side edge and the second side edge, and a first bottom edge that is parallel to the first top edge and perpendicular to the first side edge and the second side edge;

a second cutout formed in the top surface of the housing, the second cutout defined by a third side edge, a fourth side edge that is parallel to the third side edge, a second front edge that is perpendicular to the third side edge and the fourth side edge, and a second back edge that is perpendicular to the third side edge and the fourth side edge;

an oven having a pivotal door on a front surface and a back panel parallel to and opposite the front panel and an oven enclosure, the oven at least partially positioned within the first cutout such that the first side edge, the second side edge, the first top edge and the first bottom edge are adjacent to the front surface of the oven, and the oven having an air outlet in fluid communication with the oven enclosure;

a cooktop at least partially positioned within the second cutout and coupled to the oven, the cooktop spaced apart from the front surface of the housing and the back surface of the housing; and a vent assembly detachably coupled to the oven and adjacent to the back surface of the housing and at least partially positioned in the second cutout, the vent assembly comprising:

a conduit coupled to the air outlet of the oven and in fluid communication with the oven enclosure;

a vent coupled to and in fluid communication with the conduit; and a vent cover coupled to the vent;

wherein air exiting the oven enclosure moves through the air outlet of the oven and the conduit toward the vent cover to exit the oven.

2. The cooking apparatus of claim 1, wherein the vent cover is positioned higher than a top surface of the oven.

3. The cooking apparatus of claim 1, wherein the first cutout is spaced from the top surface of the housing by at least 4 inches, from the bottom surface of the housing by at least 2 inches.

4. The cooking apparatus of claim 1 wherein the cooktop is removable.

5. The cooking apparatus of claim 1, wherein the second cutout is spaced from the front surface of the housing by at least 1.6 inches, from the back surface of the housing by at least 2 inches, from the first side surface of the housing by at least 2 inches, and from the second side surface of the housing by at least 2 inches.

6. The cooking apparatus of claim 1, wherein the oven is connected to a 12V power source.

7. The cooking apparatus of claim 6, wherein the cooktop is connected to a 1.5V power source.

8. The cooking apparatus of claim 7, wherein the oven and the cooktop are connected to a source of energy.

9. The cooking apparatus of claim 1, wherein the first cutout, the second cutout, the cooktop, and the oven have the same widths.

10. The cooking apparatus of claim 1, wherein the vent has an opening that is positioned above the top surface of the housing, and the vent cover has a plurality of openings, wherein the openings are sized such that debris are precluded from entering the vent assembly.

11. A method of assembling a cooking apparatus for use in a recreational vehicle, the method comprising:

inserting an oven into a first cutout formed in the front panel of a housing, the oven having a front panel, a top panel, a bottom panel, a back panel, a first side panel, and a second side panel to define an oven enclosure, the oven enclosure in fluid communication with ambient air outside the oven, and the housing having a front surface, a top surface, a bottom surface, a back surface, a first side surface, and a second side surface;

after inserting the oven into the first cutout, coupling the oven to a 12V oven power source and an energy source;

after coupling the oven to the 12V oven power source, inserting a vent into a second cutout formed in the top surface of the housing such that the vent is adjacent to the back surface of the housing and the vent remains at least partially positioned in the second cutout and is in fluid communication with the oven enclosure;

coupling the vent along the top panel at an air outlet of the oven adjacent to the back panel of the oven;

mounting a vent cover on the vent to form a vent assembly, the vent assembly further comprising a conduit coupled to the air outlet of the oven and in fluid communication with the oven enclosure, the vent being coupled to and in fluid communication with the conduit, wherein air exiting the oven enclosure moves through the air outlet of the oven and the conduit toward the vent cover to exit the oven;

after inserting the vent into the second cutout, coupling a cooktop to a 1.5V cooktop power source and the energy source; and after coupling the cooktop to the 1.5V cooktop power source and the energy source, inserting the cooktop into the second cutout formed in the top surface of the housing such that the cooktop is spaced apart from the front surface and the back surface of the housing.

12. The method of claim 11, wherein the vent assembly has an outlet that is positioned higher than the top surface of the housing.

13. The method of claim 11, wherein coupling the vent assembly includes coupling the vent assembly over an outlet flange of the oven.

14. The method of claim 11, wherein the cooking apparatus is installed in a recreational vehicle.

15. A cooking apparatus comprising:

a housing having:

a front surface, a top surface, a bottom surface, a back surface, a first side surface, and a second side surface connected together to define a space;

a first cutout formed in the front surface of the housing, the first cutout defined by a first side edge, a second side edge that is parallel the first side edge, a first top edge that is perpendicular to the first side edge and the second side edge, and a first bottom edge that is parallel to the first top edge and perpendicular to the first side edge and the second side edge;

a second cutout formed in the top surface of the housing, the second cutout defined by a third side edge, a fourth side edge that is parallel to the third side edge, a second front edge that is perpendicular to the third side edge and the fourth side edge, and a second back edge that is perpendicular to the third side edge and the fourth side edge;

a cross member including a corner joining the front surface and the top surface of the housing, the cross member extending between the first side edge and the second side edge of the first cutout and the third side edge and the fourth side edge of the second cutout, and the cross member including the first top edge of the first cutout and the second front edge of the second cutout;

an oven having a pivotal door on a front surface and a back panel parallel to and opposite the front panel and an oven enclosure, the oven at least partially positioned within the first cutout such that the first side edge, the second side edge, the first top edge and the first bottom edge are adjacent to the front surface of the oven, and the oven having an air outlet in fluid communication with the oven enclosure;

a cooktop at least partially positioned within the second cutout and coupled to the oven, the cooktop spaced apart from the front surface of the housing and the back surface of the housing; and a vent assembly detachably coupled to the oven and adjacent to the back surface of the housing, the vent assembly comprising:

a conduit coupled to the air outlet of the oven and in fluid communication with the oven enclosure;

a vent coupled to and in fluid communication with the conduit; and a vent cover coupled to the vent;

wherein air exiting the oven enclosure moves through the air outlet of the oven and the conduit toward the vent cover to exit the oven.

16. The method of claim 11, wherein the energy source is configured to provide one of natural gas and propane to the oven and the cooktop.

* * * * *